US007784316B2

(12) United States Patent
Witschas

(10) Patent No.: US 7,784,316 B2
(45) Date of Patent: Aug. 31, 2010

(54) METHOD FOR THE INSERTION OF MACHINE UNITS INTO A PRODUCTION LINE

(75) Inventor: Eberhard Witschas, Kreuztal (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 10/593,937

(22) PCT Filed: Feb. 16, 2005

(86) PCT No.: PCT/EP2005/001550

§ 371 (c)(1),
(2), (4) Date: Sep. 22, 2006

(87) PCT Pub. No.: WO2005/095012

PCT Pub. Date: Oct. 13, 2005

(65) Prior Publication Data

US 2007/0261457 A1 Nov. 15, 2007

(30) Foreign Application Priority Data

Mar. 25, 2004 (DE) ..... 10 2004 014 579
Oct. 28, 2004 (DE) ..... 10 2004 052 395

(51) Int. Cl.
*B21B 37/24* (2006.01)

(52) U.S. Cl. ..... 72/7.1; 72/238; 72/239

(58) Field of Classification Search ..... 72/237, 72/238, 239, 444, 446, 226, 234, 6.1, 6.2, 72/7.1, 20.1, 447, 448; 700/148, 150; 702/113; 703/1, 7; 73/118.01, 865.9
See application file for complete search history.

(56) References Cited

U.S. PATENT DOCUMENTS

| | | | | |
|---|---|---|---|---|
| 4,423,612 | A * | 1/1984 | Uppaluri | 72/31.08 |
| 4,435,970 | A * | 3/1984 | Sekiya | 72/239 |
| 4,471,642 | A * | 9/1984 | Wilson | 72/238 |
| 5,941,115 | A * | 8/1999 | Minnerop et al. | 72/239 |
| 5,983,694 | A * | 11/1999 | Woodrow et al. | 72/238 |
| 6,341,897 | B1 * | 1/2002 | Palzer et al. | 384/559 |
| 6,425,278 | B1 * | 7/2002 | Aratani et al. | 72/239 |
| 6,438,534 | B1 * | 8/2002 | Sorgel | 706/61 |
| 6,837,090 | B2 * | 1/2005 | Svejkovsky | 72/226 |
| 6,904,781 | B1 * | 6/2005 | Narduzzi | 72/238 |
| 7,249,004 | B2 * | 7/2007 | Lindeman et al. | 703/1 |

OTHER PUBLICATIONS

SMS Demag Newsletter, 9, No. 2, Sep. 2002, XP002329497.

* cited by examiner

*Primary Examiner*—Edward Tolan
(74) *Attorney, Agent, or Firm*—Lucas & Mercanti, LLP; Klaus P. Stoffel

(57) ABSTRACT

The invention relates to a method for assembling and/or starting machine units in installations, such as machine beds (1) and/or roll stands (2), e.g. in an existing production line of a hot-rolling mill. In order to minimize especially the downtimes during assembly, the machine bed (1) is prefabricated and the required or cooperating machine units are prefabricated and preassembled or assembled on site next to the production line (3), whereupon said machine units are inserted into the production line (3) as a complete structural unit including the bed block (1) and allocated driving members, control elements, fastening elements or similar, pipes and cables required for operation, and additional pieces of equipment.

12 Claims, 5 Drawing Sheets

METHOD FOR THE INSERTION OF MACHINE UNITS INTO A PRODUCTION LINE

The invention concerns a method for installing machine units such as machine foundations and/or rolling stands in a plant such an existing production line of a hot rolling mill and/or for putting them into service in such plants. The machine foundation is prefabricated on site next to the production line, and the required or interacting machine units are also prefabricated, preassembled, or assembled on site. These machine units are then inserted into the production line as a complete modular unit, including the foundation block.

In the past, system units or machine units of rolling mills were produced outside the production line on temporary foundations and then moved into the production line by the use of suitable systems.

The foundations are constructed under difficult and time-consuming conditions, and after the machinery has been installed on them, further work is usually required to complete them, or, if they are temporary, they must be replaced by the final foundations, which involves a great deal of construction work.

Although foundations have been moved into place by themselves in some cases, a separate procedure was then required to install the machinery on the inserted foundation.

JP 63[1988]-030,107 A describes a rolling stand with a special design for simplifying a roll-shifting device by installing stand-shifting rails and roll-shifting rails on the same horizontal plane.

JP 59[1984]-045,010 A discloses a method and a device for replacing stands of a rolling mill. This method is intended to reduce the amount of accessible space between the stands and to decrease the total length of the production line at same time by a special way of shifting the rolling stand groups and replacing the stands.

JP 11[1999]-319,905 deals with the problem of preventing the development of wavy patterns on rolling stock and avoiding undue lowering of the rolling temperature.

For this purpose, it proposes a device in which a frame is provided with base beams attached to the mill floor and also with compression members, inlet-side tension members, central tension members, outlet-side tension members, and offset members. Finish rolling units without housings are integrated into the frame, and to increase the strength the units are connected to it by means of outlet-side tension members, connecting pins, and stoppers. During maintenance periods, a shifting device and an actuating device for the finish rolling units are advanced towards the inlet side by an actuating cylinder, which increases the distances between the actuating devices. DE-OS 2 018 383 describes a rolling stand, especially a rolling stand for shaping a continuously cast strand immediately after it leaves the continuous casting machine, and the associated rolling mill installation. Because the rolling stands are independent units, the aim is to repair and to maintain the stands at a location remote from the casting operation and to install the completely reassembled rolling stands and their drive components as quickly and simply as possible. To this end, the rolling stand and part of its drive system are designed to be detachable from the base frame or the base plate and to be vertically removable from the base frame or plate.

DE-OS 2 018 383 describes a rolling stand, especially a rolling stand for shaping a continuously cast strand immediately after it leaves the continuous casting machine, and the associated rolling mill installation. Because the rolling stands are independent units, the aim is to repair and to maintain the stands at a location remote from the casting operation and to install the completely reassembled rolling stands and their drive components as quickly and simply as possible. To this end, the rolling stand and part of its drive system are designed to be detachable from the base frame or the base plate and to be vertically removable from the base frame or plate.

Document DE-OS 2 018 490 pertains to a rolling stand for shaping a continuously cast strand after it leaves the continuous casting machine. It has two mill stand housings, in which a horizontally positioned pair of rolls and their chocks are arranged in such a way that they can be raised vertically. The mill stand housings have a rigid cross-connection at their bottom ends and a detachable cap connection at their top ends, and the rolling stand is detachably mounted on a base plate.

A problem encountered in continuous casting installations is that the rolling stands in which the strands are further shaped after the casting operation must be arranged in the smallest possible space. Every effort is made to arrange the rolling stands as closely as possible next to one another, so that the tundish installed above the continuous casting molds can have small dimensions, and so that the temperature loss of the liquid steel can be minimized. It is also necessary to arrange the rolling stands as closely as possible one behind the other. Because of the low casting speed in continuous casting, the feed rate of the strand through the rolling stands is much slower than in conventional rolling trains. If the rolling stands are too far apart, the temperature of the strand will drop too much.

Because of the compact design of the rolling stands, replacing the rolls is very difficult and requires a considerable amount of time. It is also dangerous for the personnel performing the roll change. Since the rolling stands downstream of continuous casting installations cannot operate independently of the casting and melting operations, a roll change or the replacement of the rolling stands during a changeover to a new rolling program or during repair work must be carried out as quickly as possible to avoid repercussions on the metallurgical facilities. To this end, a gear enclosed in a housing is mounted detachably on each roll shaft. The gears cooperate with a common vertical drive shaft driven from the subfloor. After the rolling stand has been disconnected from the base plate, the rolling stand, including the gears and the drive shaft, can be vertically lifted and lowered as a unit, so that drive shaft can be connected and disconnected from the drive.

JP 58[1983]-090,305 A describes a method and a device for replacing the stands in a rolling mill. To improve the efficiency of the overall device, stand-positioning frames are installed on one side of the stand train and equipped with two drive devices with different stroke lengths. In addition, horizontal moving devices are installed on both sides of the frames of the new and old stands.

JP 62[1987]-144,810 A describes a design which serves the purpose of reducing the number of stands that must be kept in readiness and which is based on the idea of keeping the roll stands that can be used as-is in place and of replacing only the other roll stands, i.e., those that cannot be used as-is, when it is necessary to change the stands. JP 01[1989]-022,410 A describes a measure for reducing the number of stands that must be kept on hand and the time required for replacing them by selective exchange of only those stands that are necessary for the roll change.

The company newsletter "SMS Demag Newsletter", Vol. 9, No. 2, September 2002, p. 31, discloses the design of a stand base plate which is installed next to a rolling train and on which the rolling stands are preassembled. This unit, which weighs about 2,500 tons, is then hydraulically pushed into the pass line. The foundations for the roll-changing equipment are first constructed in advance as prefabricated, reinforced concrete structures to cause as little interference as possible with the rolling operation.

Based on the prior art described above, the goal of the invention is to provide a method for installing machine units and/or putting them into service in plants, by which significant savings can be realized due to shorter installation times or shorter installation supervision times, so that downtime can be reduced and danger to personnel can be minimized during construction work in the immediate production and rolling area.

To achieve this goal in a method for installing machine units and/or putting them into service in plants in accordance with the introductory clause of Claim 1, the invention proposes that the associated drive elements, control elements, fastening elements, or the like, as well as pipes, cables, and other pieces of equipment necessary for operation be installed or assembled before insertion into the production line.

In an embodiment of the invention, the foundation block is mounted in a statically determined manner on at least two axes or displacement tracks, along which it can be moved into place. Before the foundation block itself is built, the displacement tracks are built on pile foundations, for example, with the help of gages and flow mortar so that they are absolutely straight, flat, and parallel to each other. For a foundation block with a width of, for example, 7.34 m, the positioning should be accurate to within ±1 mm.

The displacement track preferably has the same width over its entire length, which includes both the production line and the parallel holding line and which is at least twice as long as the width of the foundation block. As a result it is possible to use presses to lift the foundation block not only at the initial lift point but also at any other point along the entire track to allow replacement of individual bearing pads, for example, or of the high-grade steel plate along which the block slides.

These bearing pads, on which the foundation block with the assembled machine elements rests so that it can be moved into place, are connected to one another by frames and/or cables and/or chains. They can thus be pulled into position between the underside of the foundation block and the upper side of the displacement track before the displacement and can also be replaced in the same way.

Bearing pads and the different types of presses are kept in readiness for the exchanges and replacements.

A period of three working days is sufficient for installation and alignment even in cases of breakdowns in the production line. At technically possible displacement speeds of 10-20 m/h and a displacement distance of about 10 m, the time required for the displacement itself can be expected to be 30-60minutes.

For a relatively short displacement distance with relatively short traction means, a relatively large deviation from the displacement axis or direction is extremely unlikely due to the absolutely horizontal position, and therefore no lateral guides are provided. In any case, it is planned that horizontal presses be used for positional alignment in the final position in the longitudinal and transverse directions. If necessary, these presses can also be used along the displacement path, in which case they can be braced against the structural walls or the adjacent foundations. Sliding resistances of 2% to a maximum of 5% can be expected from the intended slide pairing.

To carry out the displacement, a double press, the two sides of which communicate with each other, is used to lift the foundation, on which the finished stands are mounted, to a height of about 5 cm. After the slideway and the bearing pads have been pulled into position, the foundation is moved along the track in stages of about 1 cm, alternating between the left displacement axis and the right displacement axis, under distance control.

On reaching the final position, the foundation block on the slide bearings is first aligned horizontally on the basis of reference marks on the rolling stand axes. This is followed by vertical alignment, where the same procedure as that described above for the initial lifting on two displacement axes is used. After the transverse axis has been lifted, the first step of the fine adjustment is carried out by two pairs of intercommunicating presses, one on the left and one on the right, which are actuated individually for one of the displacement axes. The height difference between left and right may not exceed a predetermined value of, for example, 2 mm.

After this first step of height adjustment on the left and the right displacement axes, the foundation is adjusted precisely around a center axis once again actuating presses, which are connected in pairs on the left and right of the center axis. As a result of partial load shifts and elastic reactions of the foundation, the fine adjustment steps described above may have to be repeated until the required accuracies are obtained. This is followed by grouting with nonshrinking grout, which can be subjected to loads after a few hours. Leaving the presses in the foundation for subsequent height corrections does not appear to be necessary in light of the above discussion but, because of the way in which the foundations are designed, it can be done, and corrections can be made again after a suitable amount of time.

The invention offers the following advantages:

- greatest possible production during modernization;
- minimum disruption of production sequences;
- maximum safety when rolling is resumed;
- construction work not carried out in the immediate production area;
- minimum downtime; and, in addition, savings of assembly costs for the supplier due to
- regular working hours of the assembly and supervisory personnel;
- use of modular units, prefabricated machine parts, and pieces of equipment, suitable for the conversion phases;
- piping and cabling on complete machine/foundation block; and finally
- completion of the foundations during the regular shift operation and thus little disruption of production by construction work and thus also reduction of the construction cost.

In an embodiment of the invention, a preliminary test run of the preassembled installations is carried out on site before they are inserted into the production line.

In another embodiment of the invention, the machine foundations are constructed in whole or in part as prefabricated, reinforced concrete structural elements in the installation area of the foundation block to be displaced, so that they can be used later as bases for new machine foundations.

Finally, in another embodiment of the method, the foundations in the roll-changing area are at least partially constructed and installed as prefabricated, reinforced concrete structures.

Additional features and details of the invention are specified in the claims and are discussed in the following description of the embodiments of the invention that are illustrated in highly schematic form in the drawings.

Figure 1:
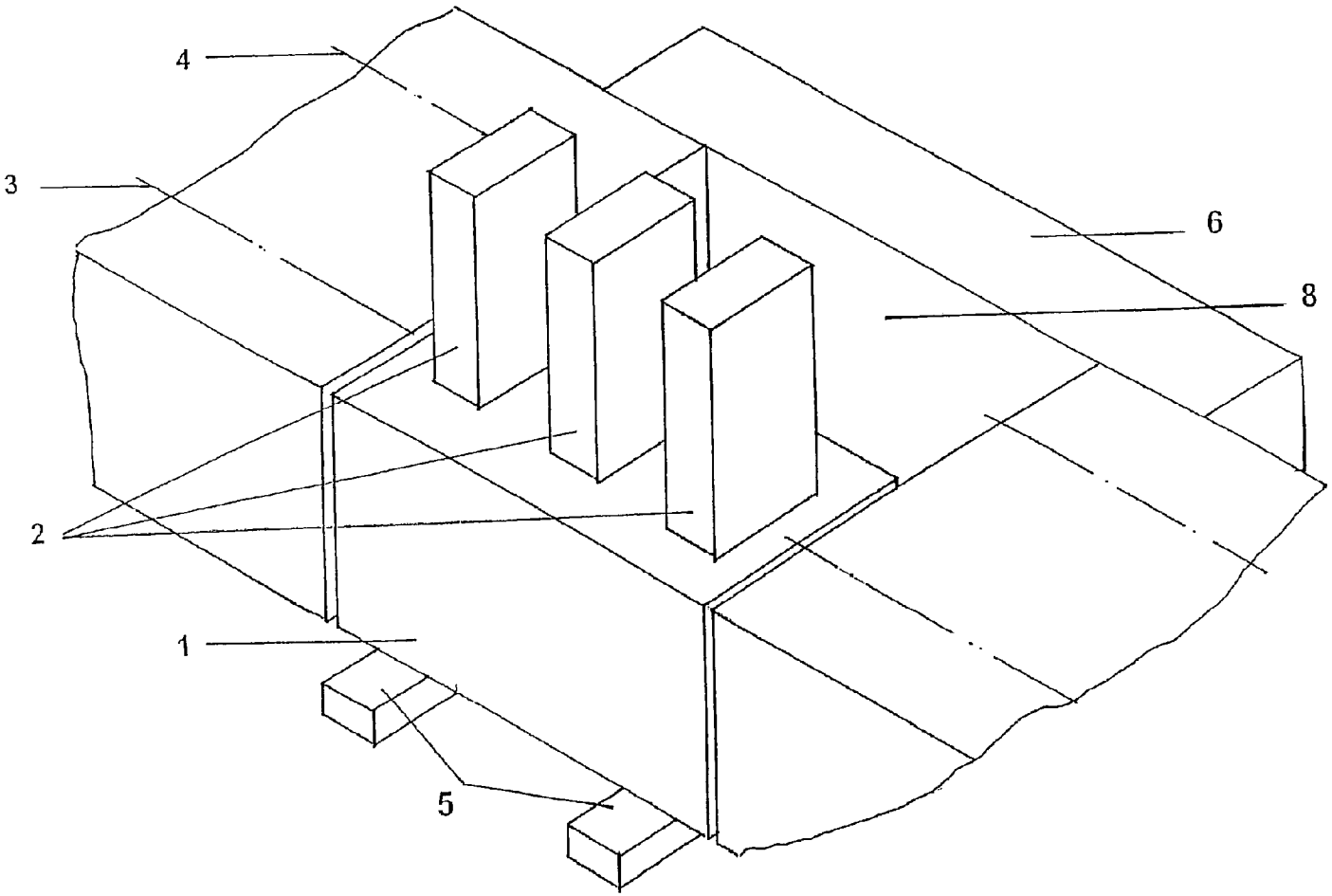
FIG. 1 shows a perspective view of a prefabricated foundation block with the finishing stands before it is inserted into the pass line.

In each of these drawings, 1 designates a foundation block, 2 designates completely assembled rolling stands, and 3 designates the course of an imaginary holding line. According to FIG. 1, to minimize the downtimes and the danger associated with construction work in the immediate production and rolling area, the finishing stands—there are three stands in the present case—are assembled and possibly operated in a test run on a prefabricated foundation block 1. During these procedures, the original production line 4 remains in operation without disruption. The foundation block 1 rests on two parallel displacement tracks 5, which are preferably perpendicular to the production line 4 and the holding line 3 and are arranged in a space 8. An abutment 6 is provided on the opposite side of the production line 4. This abutment 6 either can consist of an already existing plant structure or can be specially constructed. The traction mechanisms provided for the displacement are connected to the foundation block by traction means 7 (not shown) and are installed on the rear side (not shown) of the abutment 6.

Figure 2:
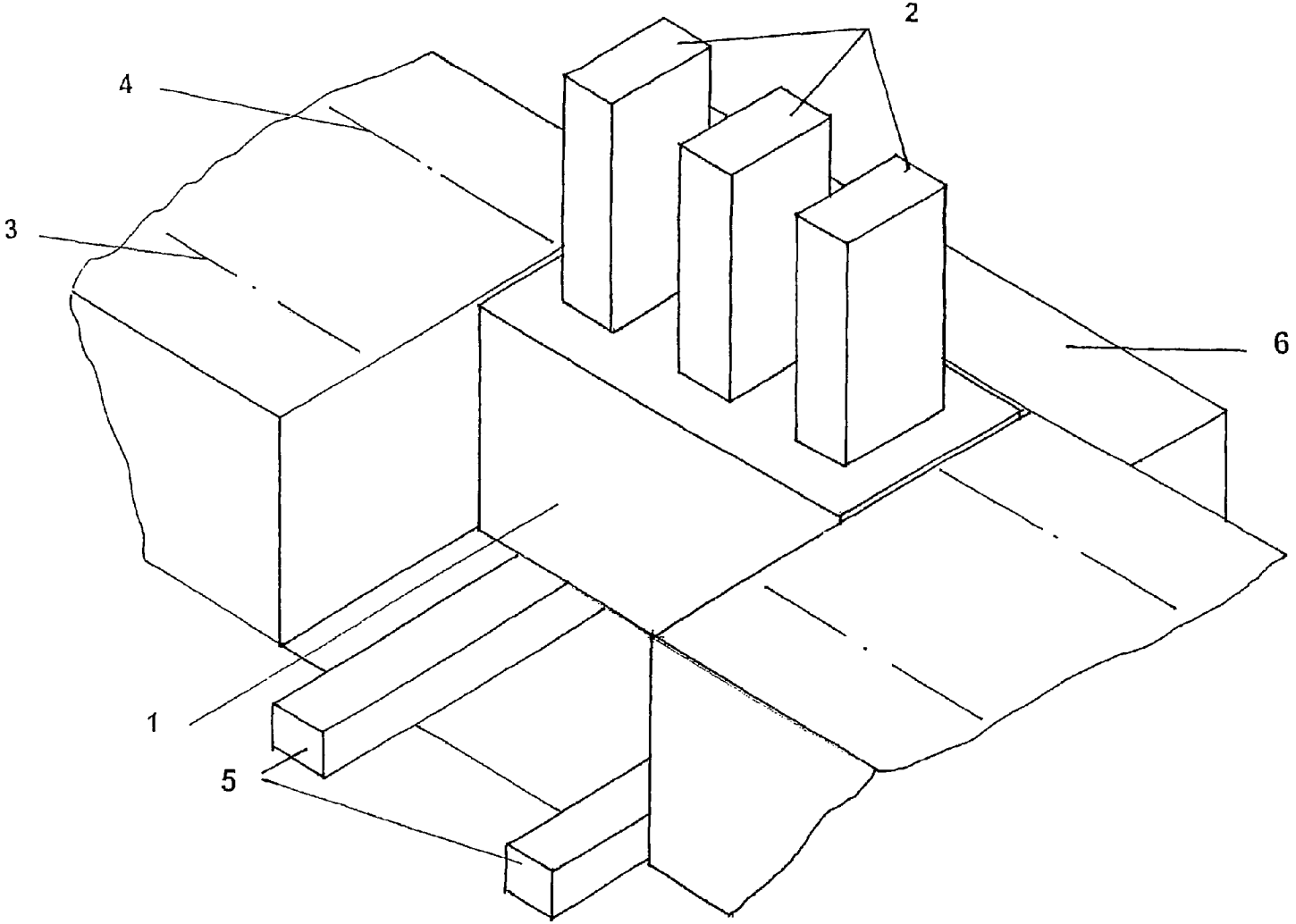
FIG. 2 shows a perspective view of the foundation block with the finishing stands in the final position (in the production line).

After the stands 2 have been prefabricated/preassembled or assembled and are ready to use, the foundation block 1 with the stands 2 is inserted into the production line, as shown in FIG. 2, and the stands are immediately integrated into the production sequence.

Figure 3:
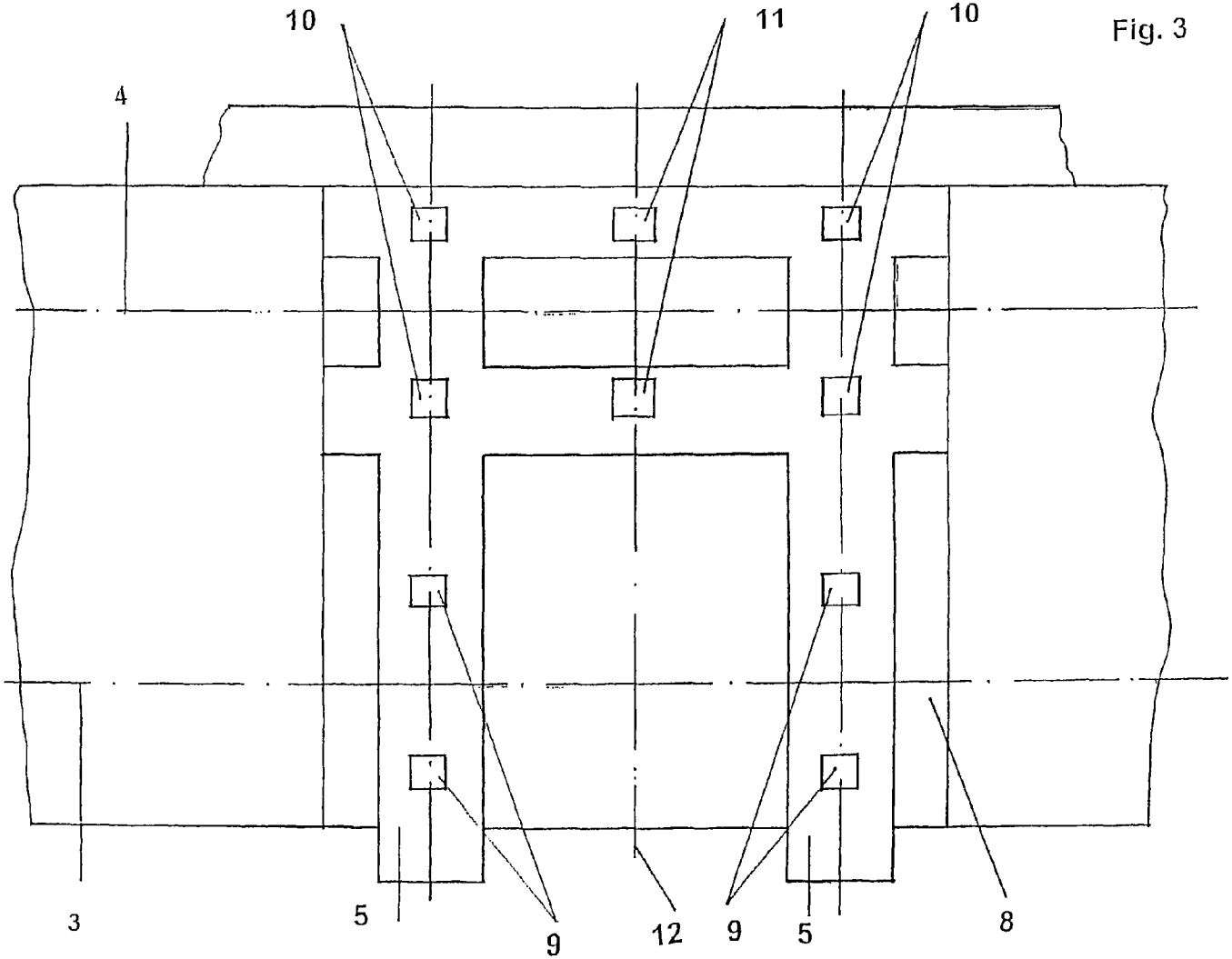
FIG. 3 shows a top view of the displacement tracks with lifting points/lifting surfaces.

FIG. 3 shows a top view of the displacement tracks, which are arranged in a space 8 of the existing plant. Whereas two lifting points/lifting surfaces 9 are provided on each of the displacement tracks 5 in the holding line 3, two additional lifting points/lifting surfaces 11 are provided in the production line 4 on the center axis 12 of the foundation block in addition to the lifting points/lifting surfaces 10 for the alignment of the foundation block 1. The lifting points/lifting surfaces 9, 10, 11 can also be doubled, if necessary, to distribute the load more evenly. Steel plates with dimensions of 500×500×80, for example, are installed as lifting points/lifting surfaces.

Figure 4:
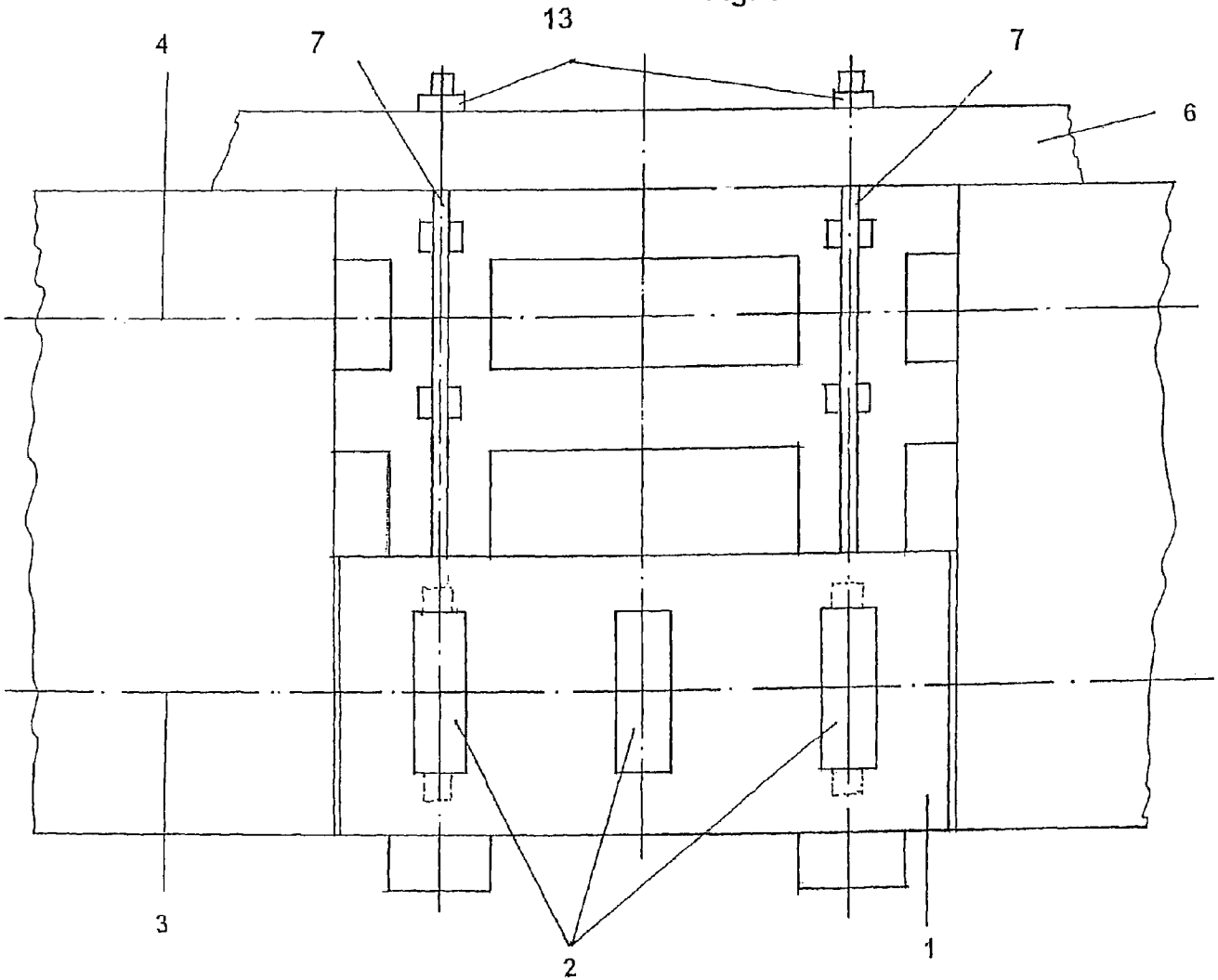
FIG. 4 shows a top view of the displacement tracks with the foundation block in the holding line.

As illustrated by the top view in FIG. 4, the foundation 1 with the stands 2 mounted on it is prepared and waiting in the holding line. Traction means 7 are then used to pull the foundation into the production line 4. The traction mechanisms 13 are supported against an abutment 6.

Figure 5:
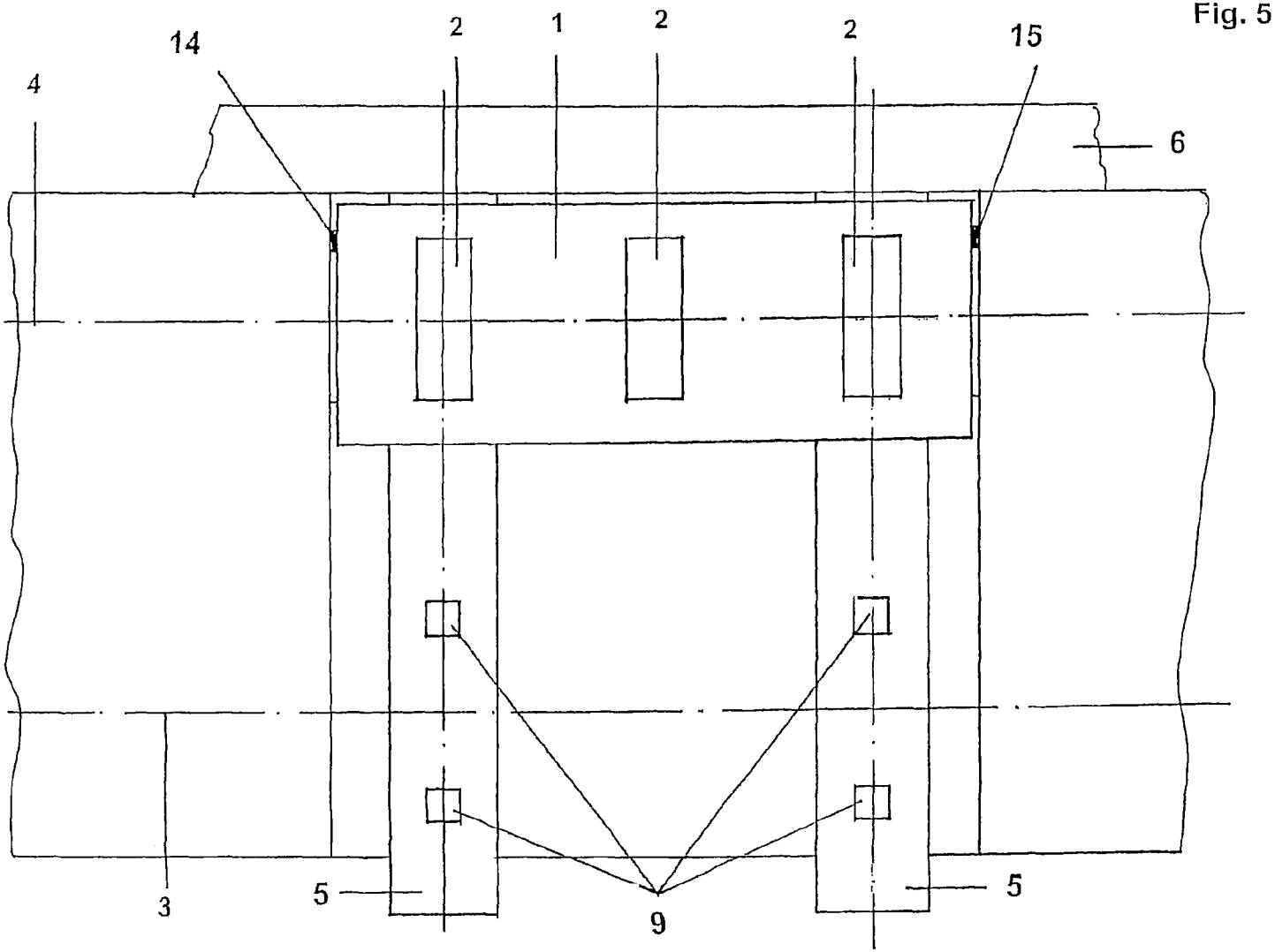
FIG. 5 shows a top view of the displacement tracks with the foundation block in the production line.

After the final position has been reached, as illustrated in FIG. 5, the foundation block 1 with the stands 2 mounted on it is aligned horizontally by means of presses 14, 15. The foundation block 1 is then raised, the slide bearings are removed, and the whole unit is dropped/lowered and vertically aligned. The space 8 is then set up as a roll-changing area, for example. The displacement tracks with the foundations can be used as a base for new machine foundations. Individual parts or components can be built from prefabricated reinforced concrete structures.

LIST OF REFERENCE NUMBERS

1 machine foundation
2 rolling stands
3 holding line
4 production line
5 displacement tracks
6 abutment
7 traction means
8 space
9 lifting point/lifting surface
10 lifting point/lifting surface
11 lifting point/lifting surface
12 center axis
13 traction mechanism
14 press
15 press

The invention claimed is:

1. Method for installing a machine unit in an existing production line of a hot rolling mill, comprising the steps of:

prefabricating a machine foundation (1);

assembling the machine unit comprising the machine foundation (1) and a rolling stand mounted on the machine foundation on site next to the production line (4) of the hot rolling mill; and inserting the machine unit into the production line (4) as a completely functional modular unit, wherein the step of assembling includes constructing the machine unit as a complete modular unit including the machine foundation (1), associated drive elements, control elements, fastening elements, as well as pipes, cables, and other pieces of equipment necessary for operation, wherein the preassembled installation is subjected to a preliminary test run on site before it is inserted into the production line (4).

2. Method according to claim 1, wherein the machine foundation (1) with the completely assembled and operationally ready rolling stand (2) is moved into place along at least two displacement tracks (5).

3. Method according to claim 2, wherein the displacement is carried out in steps alternating between a left displacement axis and a right displacement axis.

4. Method according to claim 2, wherein the machine foundation (1) to be displaced is raised; slideways are inserted between the machine foundation (1) and the displacement tracks (5); and the machine foundation (1) is displaced and then lowered after reaching its final position.

5. Method according to claim 4, wherein pairs of intercommunicating double presses are used to raise and lower the machine foundation (1).

6. Method according to claim 5, wherein the presses for raising the machine foundation (1) are supported on lifting points/lifting surfaces (9, 10, 11) embedded in the displacement tracks (5).

7. Method according to claim 5, wherein the presses for lowering the machine foundation (1) in the final position are supported on lifting points/lifting surfaces embedded in the displacement tracks (5).

8. Method according to claim 4, wherein the machine foundation (1) is horizontally aligned in the final position on the basis of reference marks on the rolling stand axes.

9. Method according to claim 4, wherein the machine foundation (1) is vertically aligned in the final position on the basis of reference marks.

10. Method according to claim 4, wherein the machine foundation (1) is finely adjusted around its transverse axis.

11. Method according to claim 1, wherein the foundations of a roll-changing area are at least partially constructed and installed as prefabricated reinforced concrete structures.

12. Method according to claim 1, wherein the machine foundations are partially or completely constructed as prefabricated reinforced concrete structural elements in the assembly area of the machine foundation (1) to be displaced, so that they can later be used as a base for new machine foundations.

* * * * *